US006499589B1

(12) United States Patent
Ngan

(10) Patent No.: US 6,499,589 B1
(45) Date of Patent: Dec. 31, 2002

(54) DISPLAY STAND

(75) Inventor: Roger Chi-Wing Ngan, Kowloon (CN)

(73) Assignee: May Cheong Toy Products Factory Limited, Kowloon (HK)

( * ) Notice: Subject to any disclaimer, the term of this patent is extended or adjusted under 35 U.S.C. 154(b) by 71 days.

(21) Appl. No.: 09/854,042

(22) Filed: May 11, 2001

(51) Int. Cl.[7] ..... B65D 5/52
(52) U.S. Cl. ..... 206/45.23; 206/45.2
(58) Field of Search ..... 206/45.2, 45.23, 206/335, 45.28, 759, 764, 767, 768, 774

(56) References Cited

U.S. PATENT DOCUMENTS 1,103,489 A * 7/1914 Conover ..... 206/45.2
3,783,999 A * 1/1974 Smith ..... 206/45.2
4,681,216 A * 7/1987 Simkins ..... 206/45.2
6,095,625 A * 8/2000 Harris et al. ..... 206/45.23
6,109,446 A * 8/2000 Foote ..... 206/759

* cited by examiner

*Primary Examiner*—Luan K. Bui
(74) *Attorney, Agent, or Firm*—Alix, Yale & Ristas, LLP

(57) ABSTRACT

A display stand comprising a body formed by two shells and a platform plate for supporting to display an article. The plate has opposite sides, and the shells are pivotably connected to the plate. Each shell includes a pair of opposed walls to define an open hollow structure which embraces a respective opposite side of the plate and has a pair of first and second adjoining open flat sides extending at substantially 90° to each other. The shells are pivotable between a first position in which their first open sides are closed by the plate and a second position in which their second open sides are closed by the plate. The arrangement is such that either one of two principal surfaces of the plate is selectively exposable on the outside of the body for supporting a article

6 Claims, 3 Drawing Sheets

DISPLAY STAND

SUMMARY OF THE INVENTION

According to the invention, there is provided a display stand comprising a body formed by two shells and a platform plate for supporting to display an article. The plate has opposite, sides, and the shells are pivotably connected to the plate. Each shell includes a pair of opposed walls to define an open hollow structure which embraces a respective opposite side of the plate and has is a pair of first and second adjoining open flat sides extending at substantially 90° to each other. The shells are pivotable between a first position in which their first open sides are closed by the plate and a second position in which their second open sides are closed by the plate. The arrangement is such that either one of two principal surfaces of the plate is selectively exposable on the outside of the body for supporting a article.

It is preferred that the body is substantially cuboidal when the shells are in either one of their first and second positions.

Preferably, the platform plate has a substantially rectangular shape.

More preferably, the opposed wails of each shell have a substantially square shape.

In a preferred embodiment, the platform plate has two opposite edge portions, and the opposed walls of each shell have respective corners at which the shell is pivotably connected to the plate, at about mid-length of the respective edge portions More preferably, the platform plate includes a pair of hinge pins at about mid-length of each of its edge portions, and the corners of the opposed walls of the two shells are formed with respective holes in engagement with the hinge pins.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figures 1, 2:
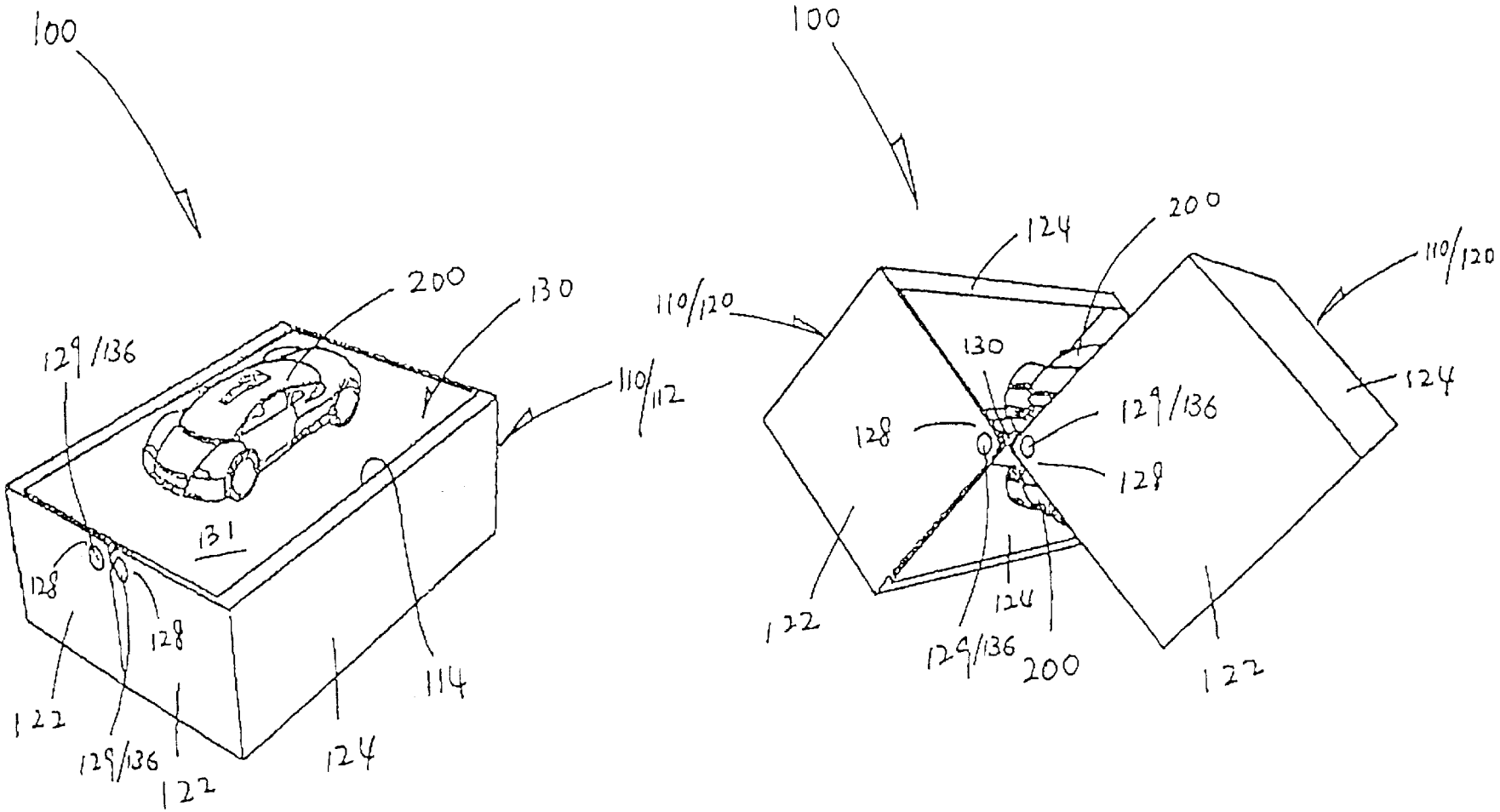
FIG. 1 is a top perspective view of an embodiment of a display stand in accordance with the invention, said stand comprising two shells and a platform plate supporting a model car.
FIG. 2 is a side perspective view of the display stand of FIG. 1, showing the two shells pivoting upwards relative to the plate.
Figure 4:
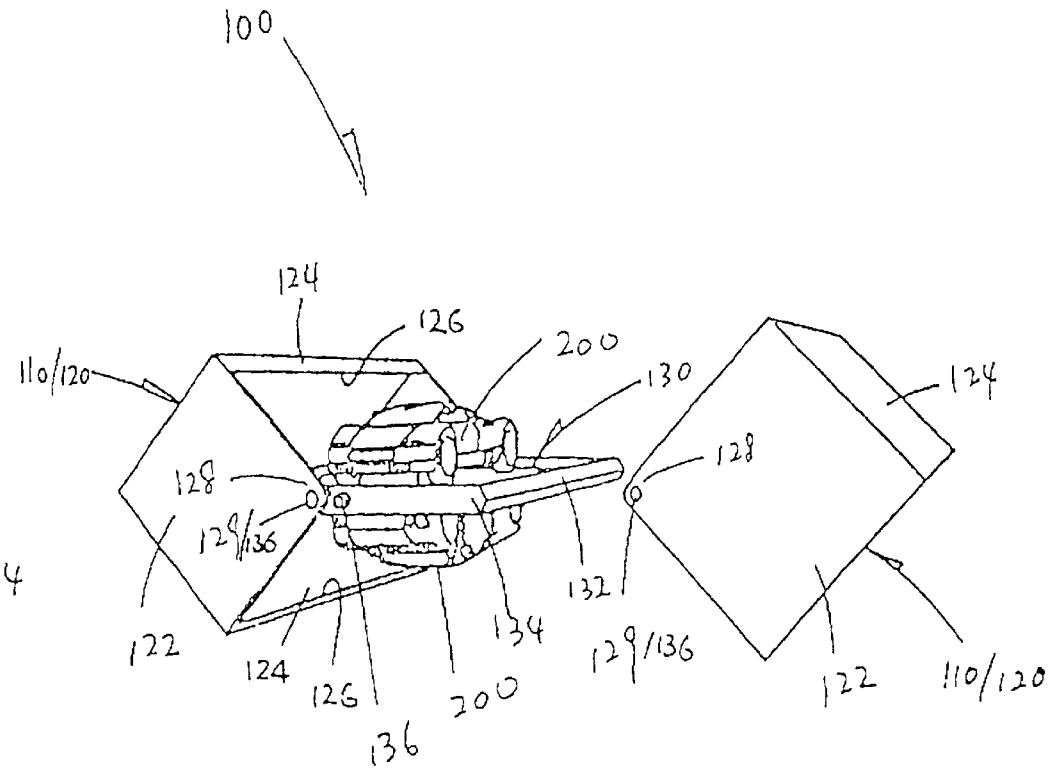
FIG. 4 is a side perspective view equivalent to FIG. 2, showing one of the shells unconnected.
Figure 3:
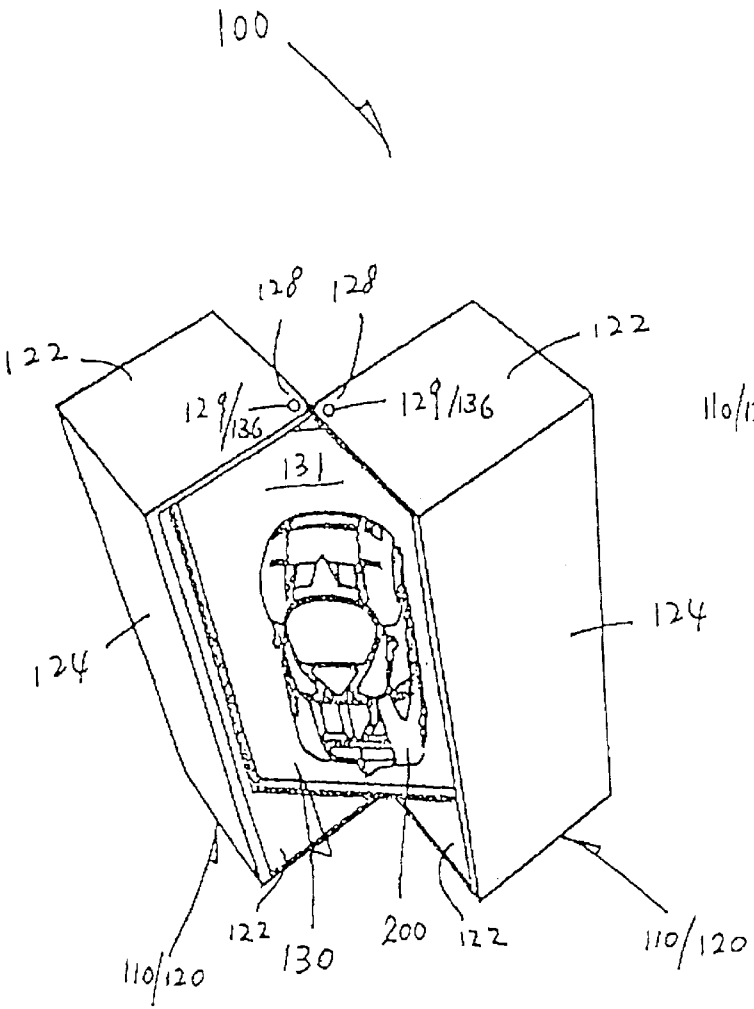
FIG. 3 is a bottom perspective view of the display stand of FIG. 2, showing the two shells pivoting further upwards.
Figure 5:
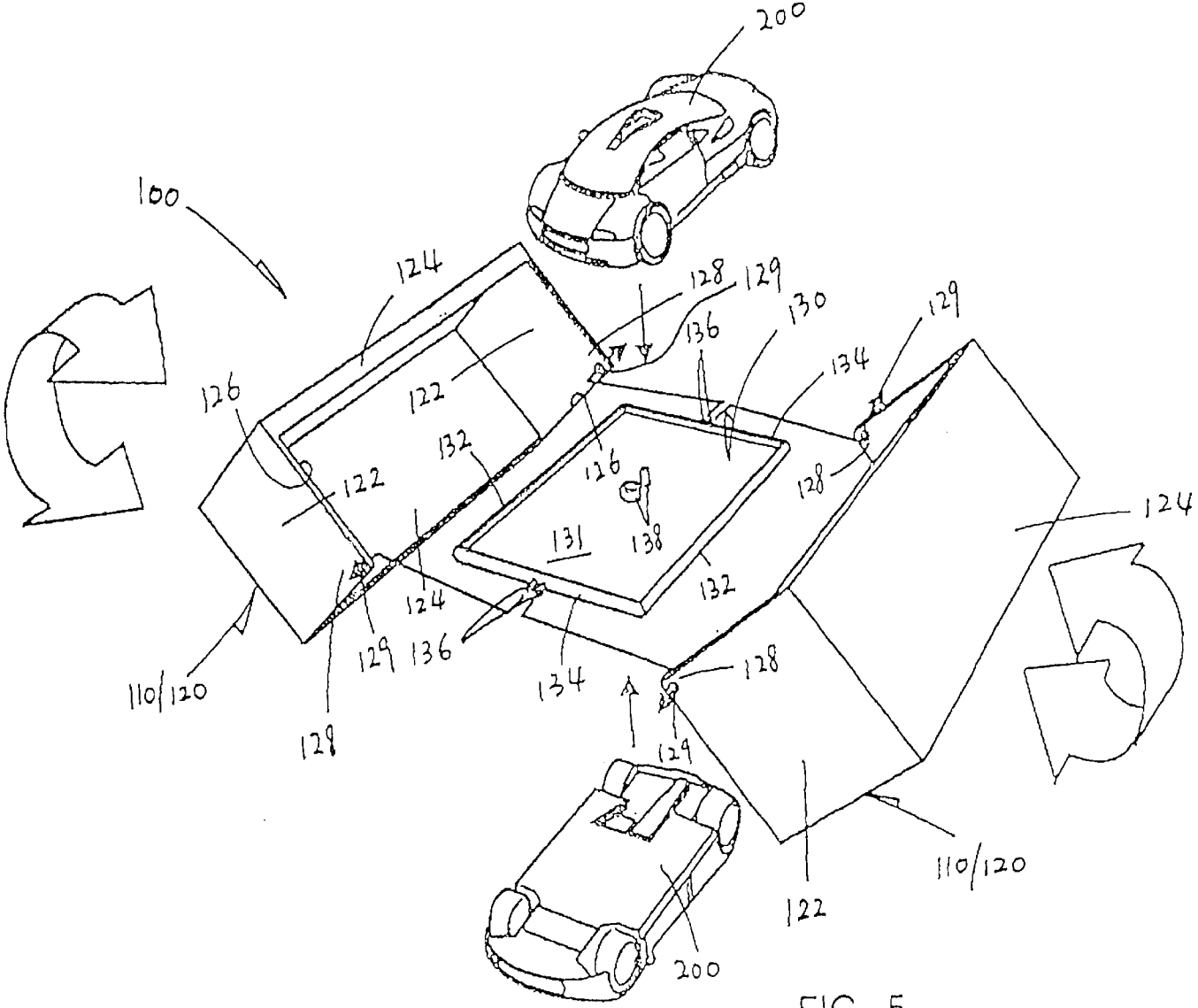
FIG. 5 is an exploded top perspective view of the display stand of FIG 1.

Referring to the drawings, there is shown a display stand 100 embodying the invention, which is designed for displaying model cars 200 for example. The display stand 100 comprises a rectangular fully closed hollow body 110 which is formed by a pair of identical left and right shells 120 arranged to form a rectangular box 112 having an open top side 114 and by a rectangular platform plate 130 closing the top side 114 Each shell 120 is in itself a cuboid that forms a respective half of the open-top box 112 split along a longitudinal central plane thereof.

Each shell 120 is formed by a pair of square opposite end walls 122 and a pair of rectangular adjoining side walls 124. The two side walls 124 are connected integrally at right angles with each other and with the two end walls 122 The resulting open hollow structure has a pair of rectangular adjoining open flat sides 126 extending at right angles to each other, with each of the end walls 122 presenting a respective exposed or free rounded corner 128 The two corners 128 are formed with respective holes 129 that are aligned with each other longitudinally with respect to the shell 120.

The platform plate 130 has two longer and two shorter edge portions 132 and 134 respectively, and is of a size such that it can just fit into the open top side 114 of the box 112. Each shorter edge portion 134 is provided with a pair of hinge pins 136 projecting longitudinally of the platform plate 130, which are located at a small distance apart from each other and at mid-length of the edge portion 134. The platform plate 130 includes, on each of its two opposite principal surfaces 131, a pair of upstanding stud and collar 138 for locating a respective model car 200.

The two shells 120 are connected separately to opposite left and right sides of the platform plate 130. To connect each shell 120, the two end walls 122 thereof are bent slightly wider apart by their corners 128 to receive therebetween the left/right sides of the platform plate 130, until such time as at least one of the holes 129 is aligned and engaged with the corresponding hinge pin 136. Upon engagement of the other hole 129 with the remaining hinge pin 136, the shell 120 is hinged to the platform plate on one side.

Each shell 120 is pivotable about the platform plate 130 through an angle of at least 90° between a first position in which one of its open sides 126 is closed by the platform plate 130 and a second position in which the other of its open sides 126 is closed by the platform plate 130 with the two shells 120 in place and pivoted in this manner, either one of the opposite principal surfaces 131 of the platform plate 130 can be exposed on the outside of the overall display stand 100.

In use, the display stand 100 may be placed on a shelf, desktop, tabletop or the like, with the exposed principal surface 131 of the platform plate 130 facing upwards for displaying the model car 200 located on that surface 131 The platform plate 130 may support two different model cars 200 on its opposite principal surfaces 131 (as shown), such that either one of them can be selected for display at will, by simply turning up (as necessary) the right side of the platform plate 130. As the other car 200 remains attached on the underside of the platform plate 130, it is being stored within the body 110. The display stand 100 serves to display as well as to store articles.

The studs and collars 138 are optional or removable to suit any other articles for display. The two (plain) principal surfaces 131 of the platform plate 130 may be of different collars, textures or designs for selective use as desired.

The invention has been given by way of example only, and various other modifications of and/or alterations to the described embodiment may be made by persons skilled in the art without departing from the scope of the invention as specified in the appended claims.

What is claimed is:

1. A display stand comprising a body formed by two shells and a platform plate for supporting to display an article, which plate has opposite sides and to which the shells are pivotably connected, each shell including a pair of opposed walls to define an open hollow structure which embraces a respective opposite side of the plate and has a pair of first and second adjoining open flat sides extending at substantially 90° to each other, said shells being pivotable between a first position in which their first open sides are closed by the plate and a second position in which their second open sides are closed by the plate, whereby either one of two principal surfaces of the plate is selectively exposable on the outside of the body for supporting a said article.

2. The display stand as claimed in claim 1, wherein the body is substantially cuboidal when the shells are in either one of their first and second positions.

3. The display stand as claimed in claim 1, wherein the platform plate has a. substantially rectangular shape.

4. The display stand as claimed in claim 3, wherein the opposed walls of each shell have a substantially square shape.

5. The display stand as claimed in claim 1, wherein the platform plate has two opposite edge portions, and the opposed walls of each shell have respective corners at which the shell is pivotably connected to the plate, at about mid-length of the respective edge portions.

6. The display stand as claimed in claim 5, wherein the platform plate includes a pair of hinge pins at about mid-length of each of its edge portions, and the corners of the opposed walls of the two shells are formed with respective holes in engagement with the hinge pins.

* * * * *